United States Patent [19]

Ottow

[11] 4,226,358

[45] Oct. 7, 1980

[54] PACKAGING CONTAINER

[75] Inventor: Alexander B. Ottow, Rotterdam, Netherlands

[73] Assignee: Internationale Octrooi Maatschappij, Rotterdam, Netherlands

[21] Appl. No.: 914,169

[22] Filed: Jun. 9, 1978

[30] Foreign Application Priority Data

Jun. 30, 1977 [GB] United Kingdom ..... 27460/77

[51] Int. Cl.[3] ..... B65D 1/00; B65D 5/66; B65D 41/18

[52] U.S. Cl. ..... 229/44 R; 206/526; 220/306; 229/25 R; 229/45 R

[58] Field of Search ..... 220/306, 3.1, 337, 339, 220/4 B, 23.4, 45 R, 45 EC; 229/2.5 R, 45 R, DIG. 9, 45 EC, 2–5 R, 44 R; 206/820, 526

[56] References Cited

U.S. PATENT DOCUMENTS

| | | | |
|---|---|---|---|
| 2,301,575 | 11/1942 | Otten | 206/273 X |
| 2,794,544 | 6/1957 | Firth | 229/39 R X |
| 2,858,224 | 10/1958 | Darrah | 229/28 R X |
| 2,884,155 | 4/1959 | Hanson | 220/23.4 |
| 3,037,681 | 6/1962 | Kuchenbecker et al. | 229/DIG. 9 |
| 3,202,272 | 8/1965 | Hertzog | 206/526 X |
| 3,511,433 | 5/1970 | Andrews et al. | 229/2.5 R X |
| 3,800,998 | 4/1974 | Gask | 206/45.34 X |
| 3,984,027 | 10/1976 | Smith | 229/2.5 R X |
| 4,061,241 | 12/1977 | Retelny | 229/2.5 R X |
| 4,096,986 | 6/1978 | Florian | 229/2.5 R X |
| 4,098,453 | 7/1978 | Arneson | 229/2.5 R X |

*Primary Examiner*—Allan N. Shoap
*Attorney, Agent, or Firm*—Barry Kramer

[57] ABSTRACT

The invention relates to a packaging container of plastics consisting of two halves, which are foldably joined. Each half comprises a cavity for receiving goods. The opening of each cavity is surrounded by a flange onto which a closing sheet is sealed. For keeping the two halves together in a folded position before and after taking out some of the goods, locking means are provided at the flanges, consisting of a tongue on one half and a slit or a cut-out on the other half. These locking means are so flexible, because of their dimensions and arrangement, that no deformation of the flanges and the sealing zone is caused by opening and closing them.

1 Claim, 9 Drawing Figures

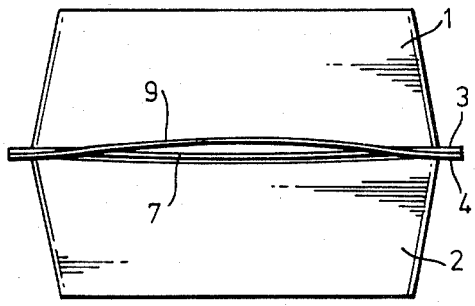
Fig.2
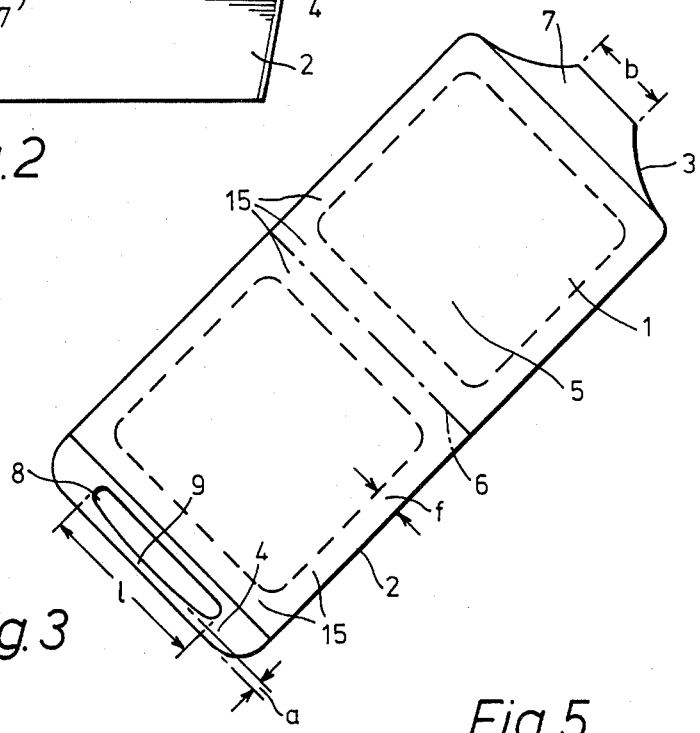
Fig.3
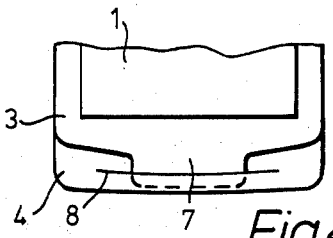
Fig.4
Fig.5
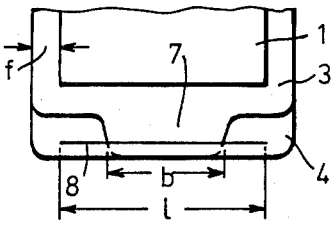
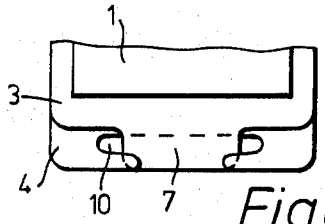
Fig.6
Fig.7
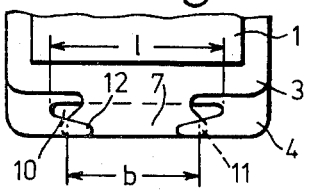

PACKAGING CONTAINER

The invention relates to a packaging container consisting of two halves which are foldably joined, each of the halves comprising a cavity for receiving goods to be packed. Such goods are e.g. sliced bread, cheese or meat. Each of the cavities is continuously surrounded by a flange extending outwardly from the openings of the cavities in such a way that they can define one plane in the unfolded position of the halves, and closed by a sheet of film which is sealed to the flanges. The halves are thermoformed by deep-drawing a film of a thermoplastic polymeric material.

Containers as described above are well-known. If they are used for packaging foodstuffs, such as sliced bread, they may contain two portions. To start consumption the closing sheet on one half is opened. Normally, however, one portion contains more slices of bread than are taken out for one meal, so that there is a need of reclosing that cavity. This can be achieved by folding the two halves together; however, for a tight closure the halves should be pressed together. The folded position will also be the form in which the container is transported, stored and sold. For these purposes the two halves should be secured to each other so that no unwanted unfolding can take place and the flanges are kept contacting each other as well as possible.

In accordance with these aspects of the invention the container is provided with locking means arranged on at least one of the three sides of the folded container on which the two halves are not directly connected to each other.

These locking means are provided on two corresponding parts of the flanges and consist of a tongue extending from the flange of the first half and of a receiving opening in the flange of the second half for inserting the tongue by a slight deformation of the tongue and the outward part beside the receiving opening. The parts of the flanges on which tongue and receiving opening are arranged are wider than is necessary for the sealing zone. The locking means are so elastic and flexible because of their shape and arrangement on the flanges that no deformation of the sealing zones of the flanges will be caused by bending the locking means in any direction for opening and closing them or in their locking position. The flexibility of the locking means depends on the thickness of the flange, which usually for containers of this kind is from 0.4 mm to 2.5 mm. According to the invention, the length of the receiving opening minus the width of the tongue (at its point contacting the outer edge beside the receiving opening) is 10 to 50 times the thickness of the flange, the length of the receiving opening and the width of the tongue being measured in the same direction, i.e. parallel to the edge of the flange.

The receiving opening can be a slit made by an incision or a cut-out in the flange of the second half. In this case the outer edge beside the slit is at least 1.5 times as wide as the thickness of the flange and can be up to 6 times wider than the thickness of the flange. Instead of by a slit the receiving opening can be formed by a cut-out which extends from and interrupts the outer edge of the second half. In this case it is advantageous if the cut-out in the flange of the seconf half has the same configuration as the tongue extending from the flange of the first half.

The halves of the container are thermoformed by deep-drawing from a thermoplastic material such as polypropylene, polyethylene, polyvinylchloride and co-polymers or laminates of such materials. The closing sheet can also be made from such a material. In case the two halves are made separately or separated after thermoforming one closing sheet, e.g. of a polyester film, may be sealed to the flanges of both halves connecting the halves and forming the hinge.

BRIEF DESCRIPTION OF THE DRAWINGS

FIG. 2 is a side-view of a container;

FIG. 3 is a container in an unfolded position;

FIGS. 4 to 7 show several locking means in locking position;

SPECIFIC EMBODIMENT OF THE INVENTION

Figure 1:
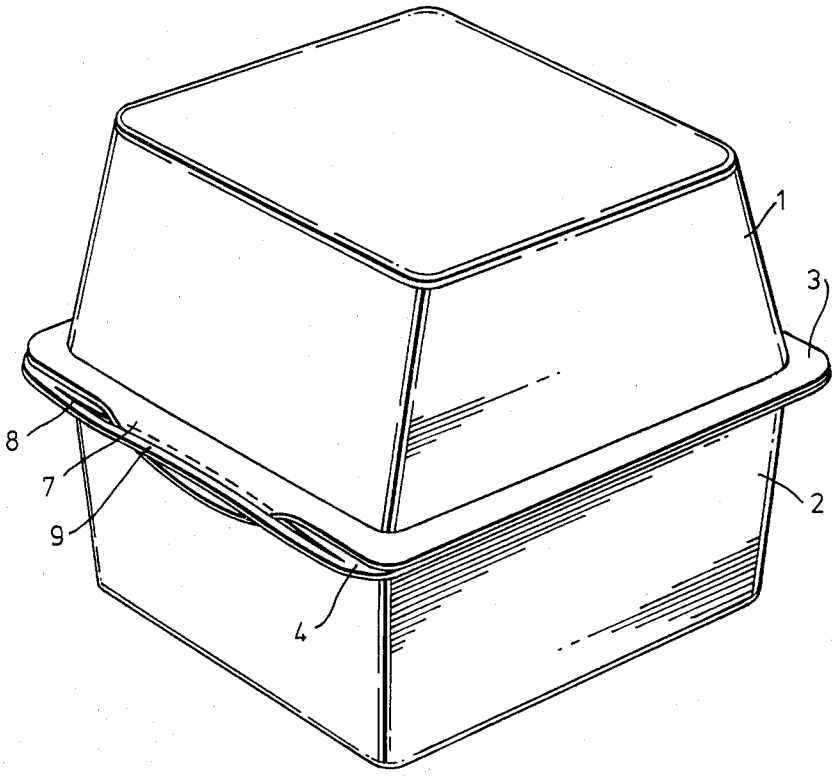
FIG. 1 is a perspective view of a container, the halves of which are folded together and locked.

The container consists of a first half 1 and a second half 2, each of which is provided with a cavity for receiving goods. There is a flange 3 on the half 1 and a flange 4 on the other half 2; the flanges outwardly surround the openings of both cavities and can define one plane. The two halves can be thermoformed from a single sheet of a thermoplastic material, a fold line being formed between the halves which does not prevent even contacting surfaces of the areas of the closing sheet sealed to the flanges. In a preferred embodiment the halves are deep-drawn independently or separated after deep-drawing and connected only by the closing sheet 5, as can be seen in FIG. 3. The sheet 5 may have a preformed fold line 6, but in case this sheet is made from an easily foldable film such as polyester no preformed fold line will be necessary. At least one side of the container, preferably at the side opposite to the hinge or fold line 6, locking means are provided, consisting of a tongue 7 on the flange 3 and a receiving opening 8 at the flange 4.

In FIG. 1 to 5 the receiving opening is a slit 8, beside which there is an outer edge 9 at the flange 4 of the second half 2. As the slit 8 has a greater length than the width of the tongue 7 at its part contacting the inner side of the outer edge 9, the outer edge 9 can be bent in order to insert the tongue 7 into the slit 8 without appreciable deformation of the sealing zone 15 on the flange 4 or of the closing sheet 5. In the same way, no deformation is caused in flange 4 by bending the tongue 7. In the locking position the outer edge 9 is slightly bent over the tongue 7, which does not cause bending of the sealing zones 15 of the flanges 3 and 4. Also in the closed position of the locking means the flanges are tightly pressed against each other, even if the cavities were opened before.

In a container as shown by way of example in FIGS. 3 and 5, the cavities having openings with a cross-section of about 8.0 by 9.5 cm, the openings are surrounded by continuous flanges which are about f=0.5 cm wide for sealing the closing sheet on them. The sealing zone 15 is as wide as the flange. The flanges 3,4 of this example are 0.8 mm thick. On the side of the locking means the flange 4 of the second half 2 is wider than the other sides for arranging the slit outside the sealing zone 15. The flange 4 is here about 1.0 cm wide. The slit 8 in flange 4 has about a length of l=7 cm. The tongue 7, which is planar with and extends from the flange 3 of the first half, has at its part contacting the outer edge 9 a width of b=4.5 cm. The length l of the slit 8 and the width b of the tongue 7 extend in the same direction along the length of the flange 4. The end of the tongue 7 can be smaller and rounded. The length of the tongue 7 is such that its end does not project over the outer edge 9. The outer edge 9 in the embodient of FIG. 3 is at least a=1.2 mm wide, the width dimension "a" being measured in a direction generally perpendicular to the length dimension "l" and width dimension "b". The dimensions for l and b can be varied as set out in the beginning. In the preferred embodiment, the length of the slit 8 minus the width of the tongue 7 at its part contacting the inner side of the outer edge 9 may be 20 to 30 times the thickness of the flange. The thickness of the tongue 7 and of the outer edge 9 is the same as that of the flange 3 and 4 and the ratio of a/d is preferably in the range of 1.5 to 6.

Figure 8:
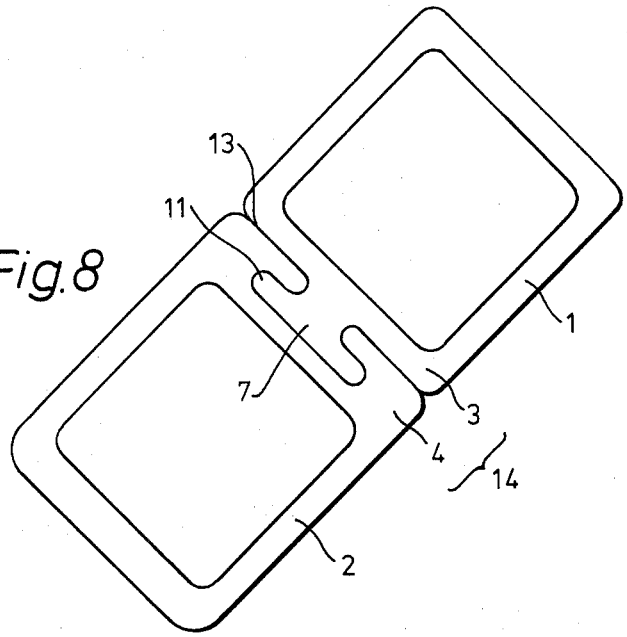
FIGS. 8 and 9 are views on first and second halves thermoformed as one piece and to be separated so that tongue and receiving opening are formed.
Figure 9:
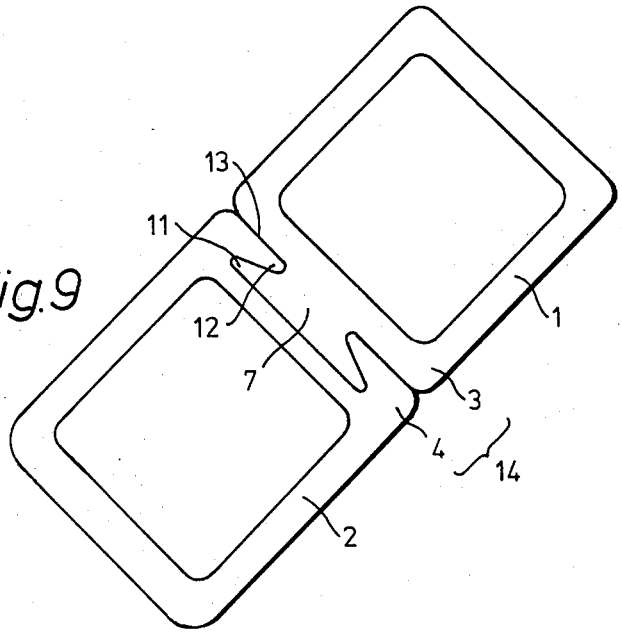

In the embodiments according to FIGS. 6 to 9 the receiving opening is formed by a cut-out 10, interrupting the outer edge of the flange 4 of the second half and forming projecting corners 12. The dimensions for l and b may be the same as for a slit; however, the tongue may have a constant or increasing width at its end. In this case tongue 7 and cut-out 10 may have the same configuration and therefore can be cut by one cut line 13 in a relatively wide flange 14 between two halves 1 and 2 thermoformed from one piece of film, as is shown in FIGS. 8 and 9.

Not only are the locking means sufficiently flexible to allow opening and closing thereof without bending the flanges 3 and 4 and the associated sealing zones 14 which might result in damage to the closing sheet, but the locking means possess further advantageous features. Locking of the halves in folded position can be achieved in a very simple way by pressing e.g. mechanically the outer edge 9 or the corners 12 against the tongue 7, whereby the tongue is bent until it snaps into the slit 8 or the cut-out 10, respectively. However, it is also possible to bend the tongue 7 against the outer edge 9, which thereby moves ut of the plane of flange 4 until it snaps over the tongue 7. As the locking means are arranged in the plane of the flanges, they do not prevent stacking of empty halves nor do they interfere with the transporting, filling and closing operations in a packaging machine. The locking means, which may be regarded as parts of the flanges, can be cut at the same time as the halves from a film after the halves have been deep-drawn, and are thus manufactured in a cheap and easy manner.

I claim:

1. A packaging container comprising:

first and second halves of a thermoplastic material foldably interconnected and each having a cavity adapted for packaging goods therein, each of said container halves having a flange extending outwardly from the corresponding cavity and surrounding the periphery of the latter, the flanges of each said container halves being essentially coplanar when said container halves are in an unfolded position and being in face-to-face abutting relationship when said container halves are in a folded, locked position;

a sheet of film sealed to zones on said flanges of each of said container halves for closing the respective cavities; and locking means carried by said flanges for keeping said container halves together in a folded position, said locking means including (1) a tongue formed in a section of the flange of said first container half, said tongue being coplanar with said last named flange and having a width dimention "b", said width dimension corresponding with the width of the tongue its points of contact with a receiving opening in which the tongue is to be engaged in said folded, locked position of said container halves, (2) said receiving opening formed in a section of the flange of said second container half for matingly receiving said tongue therein, the receiving opening having a length dimension "l" measured in a direction aligned with the width dimension "b", the sections of said flanges of said first and second container halves each having a thickness dimension "d", the ratio $$(l-b)/d$$

being in the range of 20:1 to 30:1, said receiving opening comprising a narrow longitudinal entranceway in said flange section of said second container half, said narrow entranceway being bounded by a strip of said last named flange section between said narrow entranceway and the outer periphery of said flange section of said second container half, said strip being continuous along the length of said narrow entranceway, said strip of said flange section having a width dimension "a" measured in a direction generally perpendiclar to the direction of the length dimension "l" and width dimention "b", the ratio of a/d being in the range of 1.5 to 6, the ratios of said dimensions rendering said locking means sufficiently flexible that no deformation of said zones is caused by flexing said locking means for opening and closing said locking means.

* * * * *